US007350905B2

(12) United States Patent
Sugahara

(10) Patent No.: US 7,350,905 B2
(45) Date of Patent: Apr. 1, 2008

(54) INTERNAL PRESSURE-STABILIZING APPARATUS, INK TANK AND INK-JET PRINTER INCLUDING THE SAME

(75) Inventor: Hiroto Sugahara, Ama-gun (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 372 days.

(21) Appl. No.: 11/084,773

(22) Filed: Mar. 21, 2005

(65) Prior Publication Data

US 2005/0219332 A1 Oct. 6, 2005

(30) Foreign Application Priority Data

Mar. 31, 2004 (JP) ..... 2004-103911

(51) Int. Cl.
*B41J 2/17* (2006.01)
*B41J 2/175* (2006.01)

(52) U.S. Cl. ..... 347/84; 347/86

(58) Field of Classification Search ..... 347/84, 347/86, 87, 92; 204/600; 205/98
See application file for complete search history.

(56) References Cited

U.S. PATENT DOCUMENTS 5,363,130 A * 11/1994 Cowger et al. ..... 347/92
5,801,737 A 9/1998 Sato et al.
6,502,933 B2 1/2003 Lim et al.
6,565,727 B1 * 5/2003 Shenderov ..... 204/600
7,040,743 B2 * 5/2006 Acosta et al. ..... 347/86
2002/0044183 A1 * 4/2002 Mou et al. ..... 347/86
2003/0117470 A1 * 6/2003 Shimomura et al. ..... 347/87

(Continued)

FOREIGN PATENT DOCUMENTS

EP 1 199 176 A1 4/2002

(Continued)

OTHER PUBLICATIONS

Yu-Chuan Su; Lin, L., "Geometry and surface assisted flow discretization," TRANSDUCERS, Solid-State Sensors, Actuators and Microsystems, 12th International Conference on, 2003 , vol. 2, No., pp. 1812-1815 vol. 2, Jun. 8-12, 2003.*

(Continued)

*Primary Examiner*—Stephen Meier
*Assistant Examiner*—Carlos A. Martinez, Jr.
(74) *Attorney, Agent, or Firm*—Oliff & Berridge, PLC

(57) ABSTRACT

An ink tank includes an ink chamber and a pressure-adjusting tube communicated therewith. Low liquid-repellent areas and high liquid-repellent films having liquid repellence higher than that of the low liquid-repellent areas are formed alternately in the extending direction of the tube. A difference in air pressure between both sides of a movable liquid, required for the liquid to enter the high liquid-repellent film when the liquid exists on the low liquid-repellent area disposed adjacently to the high liquid-repellent film on an atmospheric air side, is larger than that of a movable liquid required for the liquid to enter the high liquid-repellent film when the liquid exists on the low liquid-repellent area disposed adjacently to the high liquid-repellent film on an ink chamber side. It is possible to suppress the fluctuation of the internal pressure of the ink chamber of an ink-jet printer by using a simple structure.

20 Claims, 10 Drawing Sheets

U.S. PATENT DOCUMENTS

| | | | | |
|---|---|---|---|---|
| 2004/0055891 | A1* | 3/2004 | Pamula et al. | 205/98 |
| 2005/0073560 | A1* | 4/2005 | Gray et al. | 347/86 |

FOREIGN PATENT DOCUMENTS

| | | | |
|---|---|---|---|
| JP | A 2002-160383 | | 6/2002 |
| WO | WO0207503 | * | 1/2002 |

OTHER PUBLICATIONS

Lee, Y.; Kim, J.K.; Chung, S.; Chung, C.; Chang, J.K.; Yoo, J.Y., "Flow characteristics of hydrophilic/hydrophobic capillaries considering surface tension," Microtechnologies in Medicine & Biology 2nd Annual International IEEE-EMB Special Topic Conference on , vol., No., pp. 560-564, 2002.*

Doyoung Byun, B.; Ji Hye Yang; Sukhan Lee, "Effect of surface wettability on flow instability in micro-nozzle," Mechatronics, 2005. ICM '05. IEEE International Conference on , vol., No., pp. 251-254, Jul. 10-12, 2005.*

* cited by examiner

INTERNAL PRESSURE-STABILIZING APPARATUS, INK TANK AND INK-JET PRINTER INCLUDING THE SAME

BACKGROUND OF THE INVENTION

1. Field of the Invention

The present invention relates to an internal pressure-stabilizing apparatus for stabilizing the internal pressure to establish a space, and an ink tank for. accommodating an ink to be discharged onto the printing paper by an ink-jet printer.

2. Description of the Related Art

Ink-jet printers are known, which perform the printing operation by discharging inks. A known ink-jet printer of this type is provided with an ink-jet head which discharged the ink from nozzles, and an ink cartridge (ink tank) which accommodates the ink to be discharged. Individual ink flow passages, which introduce the ink supplied from the ink cartridge into the respective nozzles, are formed in the ink-jet head. In this arrangement, it is preferable that the internal pressure is maintained within a predetermined range in the ink supply system which ranges from the ink cartridge to the individual ink flow passages in order that the meniscus of the ink is stably retained at a predetermined position in each of the nozzles, and the ink does not leak and drip from the nozzles. For example, the following techniques are known. That is, the internal pressure of the ink supply system is established in accordance with the difference in liquid head by arranging the components such that the position of the ink liquid surface in the ink cartridge is lower than the position of arrangement of the nozzles. The internal pressure of the ink supply system is established in accordance with the capillary force of a porous sponge by arranging the sponge at an ink outflow port of the ink cartridge (see, for example, U.S. Pat. No. 6,502,933 (FIG. 3) corresponding to Japanese Patent Application Laid-open No. 2002-160383).

However, in the case of the former technique, it is impossible to efficiently arrange the ink-jet head and the ink cartridge due to the restriction imposed by the positional relationship between the ink-jet head and the ink cartridge. As a result, the ink-jet printer becomes large-sized. Further, if the entire apparatus is inclined, the positional relationship between the ink-jet head and the ink cartridge is changed. Therefore, it is difficult to apply the former technique to a mobile or portable ink-jet printer. On the other hand, in the case of the latter technique, the viscosity of the ink adhered in the sponge is increased as the time elapses. The flow of the ink is deteriorated. It is difficult to maintain a proper back pressure for the ink supply system. Further, a problem arises such that the sponge is consequently deteriorated due to the use for a long period of time.

SUMMARY OF THE INVENTION

In view of the above, a principal object of the present invention is to provide an internal pressure-stabilizing apparatus which makes it possible to suppress the internal pressure in a specified space to be within a preset range irrelevant to any position of arrangement and which hardly undergoes the variation of the preset internal pressure as the time elapses, an ink tank which is based on the use of the same, and an ink-jet printer which is provided with the ink tank.

According to a first aspect of the present invention, there is provided an internal pressure-stabilizing apparatus comprising a main wall member which defines a main space which accommodates a gas in at least a part thereof; and a subsidiary wall member which defines a subsidiary space communicated with the main space; wherein a plurality of first areas and a plurality of second areas having liquid repellence higher than that of the first areas are formed alternately in an extending direction of the subsidiary space on an inner wall of the subsidiary wall member; and a difference in air pressure between both sides of a liquid, which is required for the liquid to enter a second area of the second areas when the liquid exists on a first area of the first areas disposed adjacently to the second areas on a side far from the main space, is different from a difference in air pressure between both sides of a liquid which is required for the liquid to enter the second area when the liquid exists on a first area disposed adjacently to the second area on a side near to the main space.

According to the present invention, it is possible to suppress the occurrence of any great increase in the internal pressure or any great decrease in the internal pressure in the main space irrelevant to the position of arrangement of the internal pressure-stabilizing apparatus. Further, the internal pressure is scarcely fluctuated, because the respective members are hardly deteriorated.

In the present invention, the subsidiary space may have an annular cross-sectional shape which is perpendicular to the extending direction thereof, and the first areas and the second areas may be formed annularly along the inner wall of the subsidiary wall member. Accordingly, the liquid is repelled by the second area, and it is easily positioned on the first area which has higher wettability. Therefore, it is possible to efficiently suppress the occurrence of any great increase in the internal pressure or the any great decrease in the internal pressure in the main space.

In the present invention, when the difference in air pressure between the both sides of the liquid, which is required for the liquid to enter the second area when the liquid exists on the first area disposed adjacently to the second area on the side far from the main space, is larger than the difference in air pressure between the both sides of the liquid which is required for the liquid to enter the second area when that the liquid exists on the first area disposed adjacently to the second area on the side near to the main space, it is possible to suppress the occurrence of any great increase in the internal pressure in the main space.

On the other hand, when the difference in air pressure between the both sides of the liquid, which is required for the liquid to enter the second area when the liquid exists on the first area disposed adjacently to the second area on the side far from the main space, is smaller than the difference in air pressure between the both sides of the liquid which is required for the liquid to enter the second area when the liquid exists on the first area disposed adjacently to the second area on the side near to the main space, it is possible to suppress the occurrence of any great decrease in the internal pressure in the main space.

In the present invention, the subsidiary space may be open to the atmospheric air. Accordingly, it is possible to suppress any increase in the internal pressure or any decrease in the internal pressure in the main space on the basis of the atmospheric pressure.

Additionally, in the present invention, a boundary line between the second area and one of two of the first areas disposed adjacently to the second area may be a line (zigzag line) which includes portions having different angles of inclination. Accordingly, the liquid easily enters the second area from the first area at the zigzag boundary line. Accordingly, the difference in air pressure between the both sides of the liquid, which is required for the liquid existing in the first area to enter the second area disposed adjacently on the side near to the main space, can be made different from the difference in air pressure between the both sides of the liquid which is required for the liquid to enter the second area disposed adjacently on the side far from the main space, by using the simple structure. Therefore, it is possible to determine, with the simple structure, the range to suppress the increase in the internal pressure or the decrease in the internal pressure in the main space.

For example, a boundary line between the first area and the second area disposed adjacently to the first area on the side near to the main space may be a line which is perpendicular to the extending direction of the subsidiary space; and a boundary line between the first area and the second area disposed adjacently to the first area on the side far from the main space may be a zigzag line. Accordingly, the difference in air pressure between the both sides of the liquid, which is required for the liquid existing in the first area to enter the second area disposed adjacently on the side near to the main space, is made larger than the difference in air pressure between the both sides of the liquid which is required for the liquid to enter the second area disposed adjacently on the side far from the main space. Thus, it is possible to suppress, with the simple structure, any great increase in the internal pressure in the main space.

Alternatively, a boundary line between the first area and the second area disposed adjacently to the first area on the side far from the main space may be a line which is perpendicular to the extending direction of the subsidiary space; and a boundary line between the first area and the second area disposed adjacently to the first area on the side near to the main space may be a zigzag line. Accordingly, the difference in air pressure between the both sides of the liquid, which is required for the liquid existing in the first area to enter the second area disposed adjacently on the side near to the main space, is made smaller than the difference in air pressure between the both sides of the liquid which is required for the liquid to enter the second area disposed adjacently on the side far from the main space. Thus, it is possible to suppress, with the simple structure, any great decrease in the internal pressure in the main space.

Further, in the present invention, a size of a cross-sectional area of the second area, which is established at one end in the extending direction of the subsidiary space, may be different from a size of a cross-sectional area of the second area which is established at the other end. Accordingly, the force of resistance, which is brought about when the liquid enters the second area from the first area, is increased. It is possible to suppress any great increase in the internal pressure or any great decrease in the internal pressure in the main space on the basis of a higher or lower internal pressure.

Additionally, in the present invention, a plurality of zones, which have liquid repellence higher than that of the first area, may be provided in the second area so that the liquid repellence is gradually increased from one side to the other side of the second area in the extending direction of the subsidiary space. Accordingly, it is possible to increase the force of resistance required for the liquid to enter the second area disposed adjacently on one side from the first area, while it is possible to decrease the force of resistance required for the liquid to enter the second area disposed adjacently on the other side. Therefore, it is possible to more accurately suppress the increase in the internal pressure or the decrease in the internal pressure in the main space.

In the present invention, a large number of portions, which have liquid repellence different from that of the second area, may be formed in the second area; and an average density of the portions having the different liquid repellence in the second area may be gradually increased from one side to the other side in the extending direction of the subsidiary space. Accordingly, it is possible to more accurately suppress the increase in the internal pressure or the decrease in the internal pressure in the main space.

In the present invention, an ink may be accommodated in the main space, and an ink supply tube may be formed to supply the ink contained in the main space to the outside. Accordingly, a preferred ink tank can be employed, in which the internal pressure is scarcely fluctuated in the ink supply system.

According to a second aspect of the present invention, there is provided an ink tank for an ink-jet printer comprising a main wall member which defines a main space which accommodates an ink and which has an ink discharge port to be communicated with nozzles which discharge the ink; and a subsidiary wall member which defines a subsidiary space communicated with the main space and which has an open hole which opens the subsidiary space to the atmospheric air. A plurality of first areas and a plurality of second areas having liquid repellence higher than that of the first areas are formed alternately in an extending direction of the subsidiary space on an inner wall of the subsidiary wall member. A difference in air pressure between both sides of a liquid, which is required for the liquid to enter a second area of the second areas when the liquid exists on a first area of the first areas disposed adjacently to the second area on a side far from the main space, is larger than a difference in air pressure between both sides of a liquid which is required for the liquid to enter the second area when the liquid exists on a first area disposed adjacently to the second area on a side near to the main space.

According to the present invention, the restriction disappears in the positional relationship between the ink tank and the nozzles possessed by the ink-jet head. Accordingly, it is possible to miniaturize the ink-jet printer by efficiently arranging the ink-jet head and the ink tank. Further, a proper internal pressure can be provided for the internal pressure of the ink supply system including the main space. Therefore, it is possible to efficiently discharge the ink droplets from the nozzles while avoiding any leakage of the ink from the nozzles.

According to a third aspect of the present invention, there is provided an ink-jet printer comprising:

an ink-jet head which discharges an ink; and an ink tank which stores the ink to be supplied to the ink-jet head, the ink tank comprising:

a main wall member which defines a main space which accommodates the ink and which has an ink discharge port to be communicated with nozzles which discharge the ink; and a subsidiary wall member which defines a subsidiary space communicated with the main space and which has an open hole which opens the subsidiary space to atmospheric air, wherein:

a plurality of first areas and a plurality of second areas having liquid repellence higher than that of the first areas are formed alternately in an extending direction of the subsidiary space on an inner wall of the subsidiary wall member; and a difference in air pressure between both sides of a liquid, which is required for the liquid to enter a second area of the second areas when the liquid exists on a first area of the first areas disposed adjacently to the second area on a side far from the main space, is larger than a difference in air pressure between both sides of a liquid which is required for the liquid to enter the second area when the liquid exists on a first area disposed adjacently to the second area on a side near to the main space.

DESCRIPTION OF THE PREFERRED EMBODIMENTS

A preferred first embodiment of the present invention will be explained below with reference to the drawings.

Figure 1:
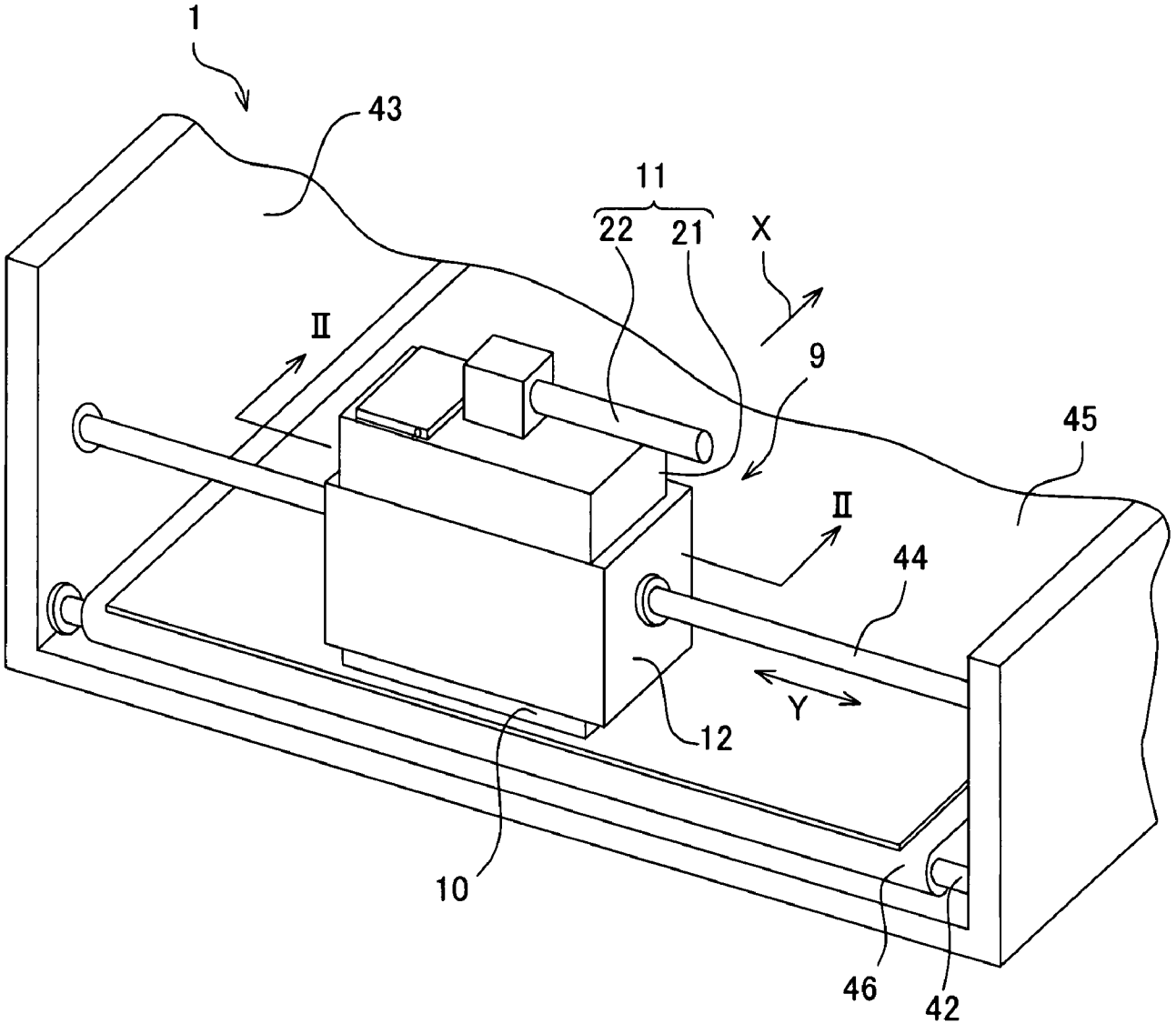
FIG. 1 shows an appearance of an ink-jet printer provided with an ink tank according to a first embodiment of the present invention.

FIG. 1 is a sectional view showing a schematic arrangement of an ink-jet printer including an ink tank according to the first embodiment. As shown in FIG. 1, the ink-jet printer 1 according to the embodiment of the present invention includes a transport belt 46 as a transport means which transports the printing paper 45 as a medium subjected to the printing, and an ink-jet head 9 which discharges ink droplets onto the printing paper 45 set on the transport belt 46.

The transport belt 46 is wound around a shaft 42 which is rotatably fixed to a frame 43. The transport belt 46 is rotated by the shaft 42 which is to be driven and rotated by an unillustrated motor. The printing paper 45 is fed from a paper feed cassette (not shown) which is provided in the vicinity of the ink-jet printer 1. The printing paper 45 is transported at a constant speed in the printing paper transport direction X by the transport belt 46. The printing paper 45, which is transported by the transport belt 46, is subjected to a predetermined printing operation with ink droplets discharged from the ink-jet head 9. After that, the printing paper 45 is discharged. Detailed illustration of a paper feed mechanism and a paper discharge mechanism for the printing paper 45 is omitted from FIG. 1.

The ink-jet head 9 is attached to a shaft 44 which extends perpendicularly to the printing paper transport direction X. The ink-jet head 9 is movable along the shaft 44 by the aid of an unillustrated driving mechanism. In other words, the ink-jet head 9 is a serial head which is movable in the head transport direction Y perpendicular to the printing paper transport direction X. The ink-jet printer 1 depicted in FIG. 1 is a monochrome or black and white printer in which only one ink-jet head 9 is arranged. However, when the color printing is performed, at least four ink-jet heads 9 for yellow (Y), magenta (M), cyan (C), and black (K) are arranged in parallel in the printing paper transport direction X.

Figure 2:
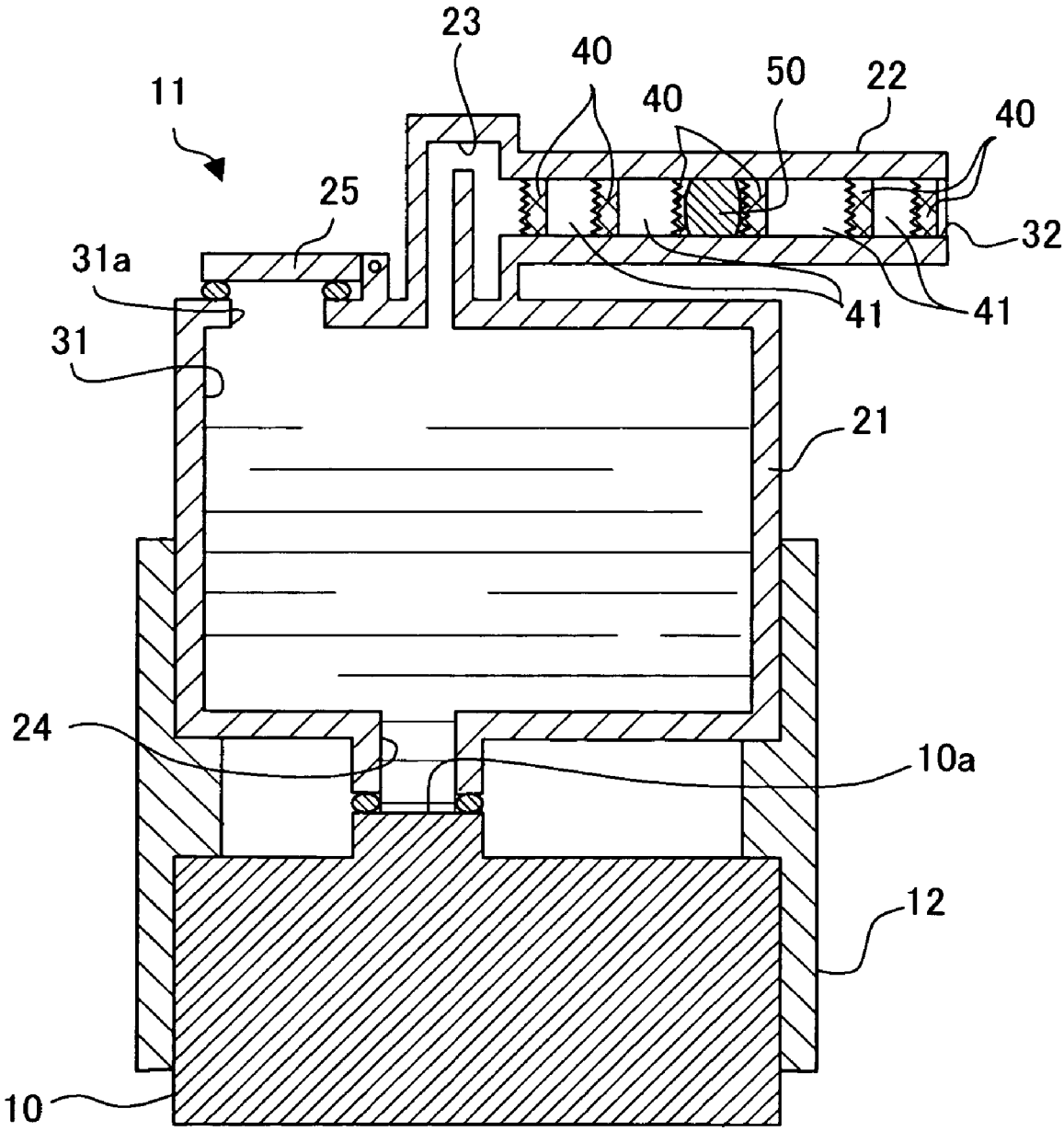
FIG. 2 shows a sectional view taken along a line II-II shown in FIG. 1.

Next, the ink-jet head 9 will be explained with reference to FIG. 2. FIG. 2 shows a sectional view taken along a line II-II illustrating the ink-jet head 9 shown in FIG. 1. As shown in FIG. 2, the ink-jet head 9 includes a head main body 10, an ink tank (internal pressure-stabilizing apparatus) 11, and a carriage 12 which is movable in the head transport direction Y and which supports the head main body 10 and the ink tank 11. The head main body 10 is rectangular parallelepiped-shaped, and it has an ink discharge surface which is disposed on the lower surface opposed to the printing paper 45 and which is formed with a large number of nozzles. A large number of individual ink flow passages, which are communicated with the respective nozzles, are formed in the head main body 10. An ink inflow port 10*a*, which is communicated with all of the individual ink flow passages, is formed on the upper surface of the head main body 10 as the surface opposite to the ink discharge surface. The ink is poured into the ink inflow port 10*a* from the ink tank 11 as described later on. The ink, which is poured from the ink inflow port 10*a*, is distributed to all of the individual ink flow passages. Actuators are arranged to correspond to pressure chambers each of which is formed for a part of the individual ink flow passage in the head main body 10. When the respective actuators are driven, then the pressure is generated in the corresponding pressure chambers, and the ink droplets contained in the pressure chambers are discharged from the nozzles.

The ink tank 11 is detachable with respect to the carriage 12. The ink tank 11 includes a tank main body (main wall member or body) 21, and a pressure-adjusting tube (subsidiary wall member or body) 22 which is arranged on an upper portion of the tank main body 21. The tank main body 21 includes an ink chamber (main space) 31, a communication passage 23 which is communicated with the ink chamber 31 and a pressure-adjusting space (subsidiary space) 32 as an internal space of the pressure-adjusting tube 22, an ink supply tube 24, and a hatch 25. The ink chamber 31 accommodates the ink, and it is rectangular parallelepiped-shaped.

The communication passage 23 is arranged at the center of the upper wall surface of the ink chamber 31, and it is communicated with the ink chamber 31. The communication passage 23 extends in the upward direction from the communicating portion with respect to the ink chamber 31, and then it is bent to extend in the downward direction. The communication passage 23 extends in the downward direction to a portion at which the communication passage 23 is communicated with the pressure-adjusting space 32. In other words, the ink chamber 31 is communicated with the pressure-adjusting space 32 via the communication passage 23. The ink supply tube 24 is provided to supply the ink contained in the ink chamber 31 to the head main body 10. The ink supply tube 24 is arranged at the center of the bottom wall surface of the ink chamber 31. The ink supply tube 24 is communicated with the ink chamber 31, and extends vertically in the downward direction from the communicating portion with respect to the ink chamber 31. When the ink tank 11 is installed to the carriage 12, the ink supply tube 24 is connected to the ink inflow port 10*a* which is formed on the upper surface of the head main body 10. When the ink supply tube 24 is connected to the ink inflow port 10*a*, the ink, which is accommodated in the ink chamber 31, flows via the ink supply tube 24 and the ink inflow port 10*a*, and the ink is distributed to the individual ink flow passages formed in the head main body 10.

The hatch 25 is provided to open/close a hole 31*a* which is formed through the upper wall surface of the ink chamber 31 in order to pour or inject the ink into the ink chamber 31. The hatch 25 is a rectangular thin plate, which is supported rotatably about the center of one side at the outside of the upper wall surface of the ink chamber 31. When the ink is poured or injected into the ink chamber 31, the hatch 25 is rotated to a position separated from the hole 31*a* to expose the hole 31*a*. During the printing operation, the hatch 25 is rotated to a position at which the flat surface of the hatch 25 makes contact with the entire opening of the hole 31*a* to seal the hole 31*a*. When the ink is poured or injected into the ink chamber 31, then the ink tank 11 is detached from the carriage 12, and the end of the ink supply tube 24 is sealed. After that, the hatch 25 is opened, and the ink is poured or injected from the hole 31*a*. In this situation, the hole 31*a* is communicated with the atmospheric air, and hence the internal pressure of the ink chamber 31 is the atmospheric pressure as well. When the pouring or injecting operation of the ink is completed, then the hatch 25 is closed, the end of the ink supply tube 24 is opened, and the ink tank 11 is installed to the carriage 12.

The pressure-adjusting tube 22 has a cylindrical shape (see FIG. 1) which extends from the communication passage 23 in the head transport direction Y (horizontal direction as viewed in the drawing). The pressure-adjusting space 32 is formed in the pressure-adjusting tube 22. A cross-sectional shape of the pressure-adjusting tube 22, which is perpendicular to the extending direction of the pressure-adjusting tube 22, is annular. One end of the pressure-adjusting space 32 is communicated with the atmospheric air (open to the atmospheric air), and the other end is communicated with the communication passage 23. In the following description, the side of one end of the pressure-adjusting space 32, which is communicated with the atmospheric air, is referred to as "atmospheric air side (side far from the main space)", and the side of the other end, which is communicated with the ink chamber 31 via the communication passage 23, is referred to as "ink chamber 31 side (side near to the main space)". A large number of high liquid-repellent films (second areas) 40, which have liquid repellence higher than liquid repellence of the inner wall of the pressure-adjusting space 32, are formed on the inner wall of the pressure-adjusting space 32 so that the high liquid-repellent films 40 are annular along the inner wall of the pressure-adjusting space 32. The high liquid-repellent films 40 are arranged in the pressure-adjusting space 32 so that the high liquid-repellent films 40 and low liquid-repellent areas (first areas) 41 on which the high liquid-repellent films 40 are not formed appear alternately in the extending direction of the pressure-adjusting space 32. In this arrangement, the low liquid-repellent areas 41 are annular along the inner wall of the pressure-adjusting space 32. The boundary line of the high liquid-repellent film 40, which is disposed with respect to the low liquid-repellent area 41 on the atmospheric air side, is composed of a straight line which is perpendicular to the extending direction of the pressure-adjusting tube 22. The boundary line, which is disposed with respect to the low liquid-repellent area 41 on the ink chamber 31 side, has a zigzag shape in which straight lines having opposite directions of inclination with respect to the straight line perpendicular to the extending direction of the pressure-adjusting tube 22 are alternately aligned. The high liquid-repellent film can be formed of, for example, a fluororesin.

A movable liquid 50, which is movable on the high liquid-repellent films 40 and the low liquid-repellent areas 41 in the extending direction of the pressure-adjusting space 32, is arranged in the pressure-adjusting space 32 so that the pressure-adjusting space 32 is shut off (isolated to two spaces by the movable liquid 50 so that one of the spaces is not communicated with the atmospheric air). The movable liquid 50 is repelled by the high liquid-repellent film 40. Therefore, the movable liquid 50 always stops on any one of the low liquid-repellent areas 41. When the movable liquid 50 is positioned on the low liquid-repellent area 41, the movable liquid 50 makes contacts with ends of the high liquid-repellent films 40 which are disposed adjacently to the low liquid-repellent area 41 on the both sides. The movable liquid 50 forms the meniscus so that a predetermined angle of elevation is provided at the contact surface with respect to the high liquid-repellent film 40. Those usable as the movable liquid 50 include water and nonvolatile liquids.

Figure 13A:
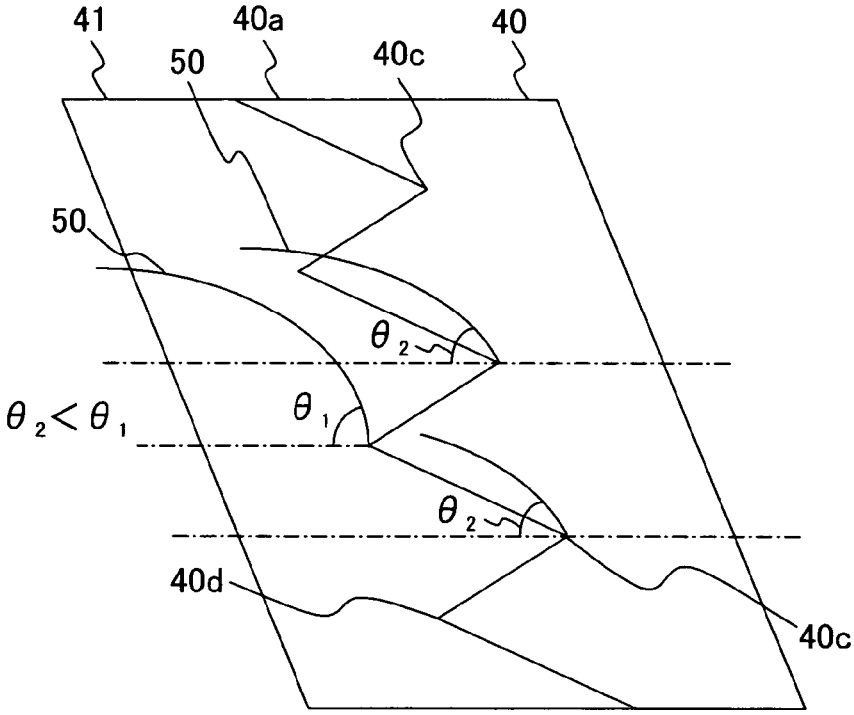
FIGS. 13A and 13B illustrate the principle for the movable liquid positioned on a low liquid-repellent area to enter a high liquid-repellent film 40 disposed adjacently on an ink chamber side.
Figure 13B:
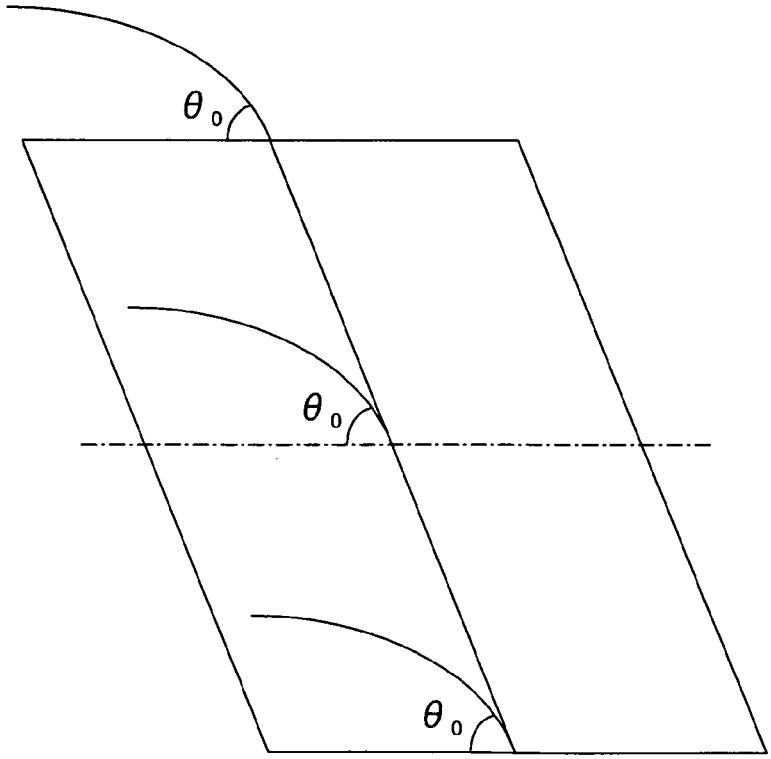

When the boundary line of the high liquid-repellent film 40, which is disposed on the ink chamber 31 side, has the zigzag shape, the movable liquid 50, which is positioned on the low liquid-repellent area 41, enters the high liquid-repellent film 40 adjoining on the atmospheric air side more easily than the high liquid-repellent film 40 adjoining on the ink chamber 31 side, for the following reason. That is, the critical angle of elevation of the meniscus of the movable liquid 50, which is formed when the meniscus of the movable liquid 50 is broken to enter the high liquid-repellent film 40, is constant. Therefore, the angle of elevation of the meniscus of the movable liquid 50 is larger than those of other portions, and it easily arrives at the critical angle of elevation at the tip of the zigzag shape formed by two straight line portions having different angles of inclination disposed nearest to the ink chamber 31 side, of the boundary line of the high liquid-repellent film 40 during the process in which the movable liquid 50 arranged on the low liquid-repellent area 41 enters the high liquid-repellent film 40 adjoining on the atmospheric air side. In view of the liquid repellence, it is affirmed that the boundary portion (zigzag boundary) of the high liquid-repellent film 40, which is disposed on the ink chamber 31 side, has the liquid repellence lower than that of the boundary line (straight line boundary) of the high liquid-repellent film 40 which is disposed on the atmospheric air side. This phenomenon will be explained with reference to FIGS. 13A and 13B. FIG. 13A shows a magnified view illustrating those disposed in the vicinity of the boundary between the low liquid-repellent area 41 and the high liquid-repellent film 40. The end 40*a* of the high liquid-repellent film 40 is formed to have the zigzag shape. Therefore, the ink droplets 50, which have been advanced to the end 40*a* from the low liquid-repellent area 41, stay at different angles depending on the positions of the zigzag shape. That is, the contact angle θ1 (rising angle of the ink meniscus of the ink droplet 50), which is obtained at the tip 40*d* of the zigzag shape of the end 40*a* (on the side near to the ink chamber), is larger than the contact angle θ2 of the liquid which is obtained at the bottom 40*c* of the zigzag shape of the end 40*a* (on the side far from the ink chamber), for the following reason. That is, the larger contact angle can be maintained at the tip 40*d* of the zigzag shape by the aid of the surface tension, because the liquid exists on the both sides of the tip 40*d*. Therefore, when the ink droplet 50 approaches the boundary between the end 40*a* and the low liquid-repellent area 41, and the force in the rightward direction, which facilitates the ink droplet 50 to transfer to the end 40*a*, is applied to the ink droplet 50, then the contact angle is increased at the tip 40*d* of the zigzag shape as compared with other portions to arrive at the critical angle with ease. On the contrary, as shown in FIG. 13B, when the boundary is a straight line, the contact angle θ0 is identical at any position. Therefore, the liquid arrives at the critical angle earlier in the case of FIG. 13A than in the case of FIG. 13B, and the liquid enters the end 40*a* of the high liquid-repellent film 40.

The movable liquid 50 shuts off the pressure-adjusting space 32 so that the pressure-adjusting space 32 is divided into those on the ink chamber 31 side and on the atmospheric air side. Therefore, assuming that the atmospheric pressure is scarcely changed, the movable liquid 50 is moved in the pressure-adjusting space 32 principally depending on the change in the internal pressure of the ink chamber 31. For example, when the internal pressure of the ink chamber 31 is lower than the atmospheric pressure, the movable liquid 50 intends to move toward the ink chamber 31 side in the pressure-adjusting space 32. When the movable liquid 50 is moved toward the ink chamber 31 side, the internal pressure of the ink chamber 31 is raised. On the contrary, when the internal pressure of the ink chamber 31 is higher than the atmospheric pressure, the movable liquid 50 intends to move toward the atmospheric air side in the pressure-adjusting space 32. When the movable liquid 50 is moved toward the atmospheric air side, the internal pressure of the ink chamber 31 is lowered.

Figure 3A:
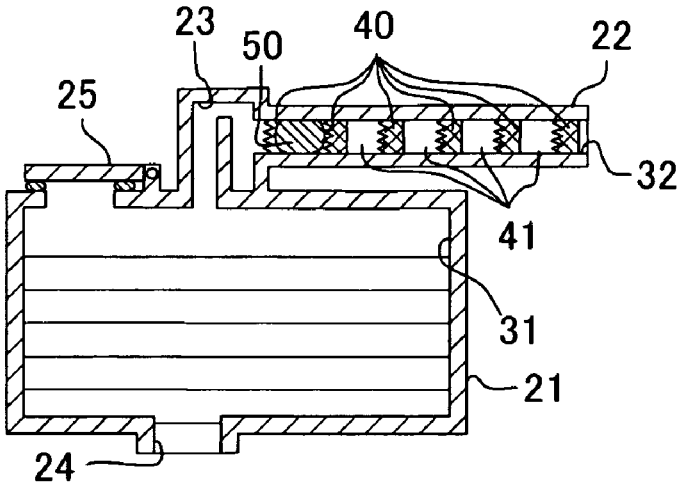
FIG. 3 shows a relationship between the operation state of the ink tank shown in FIG. 2 and the change in internal pressure in an ink chamber.
Figure 3B:
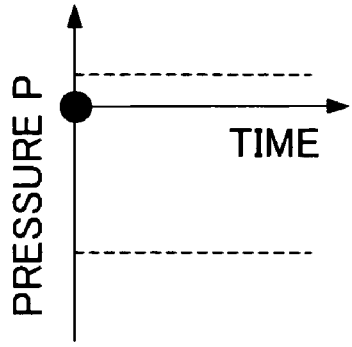

As described above, the movable liquid 50, which is positioned on the low liquid-repellent area 41, easily enters the high liquid-repellent film 40 adjoining on the atmospheric air side as compared with the high liquid-repellent film 40 adjoining on the ink chamber 31 side. Therefore, the difference in air pressure between the both sides of the movable liquid 50, i.e., the decrement of the internal pressure of the ink chamber 31 with respect to the atmospheric pressure, which is required when the movable liquid 50, that exists in the low liquid-repellent area 41 adjacent to the high liquid-repellent film 40 on the atmospheric air side, enters the high liquid-repellent film 40, is larger than the difference in air pressure between the both sides of the movable liquid 50, i.e., the increment of the internal pressure of the ink chamber 31 with respect to the atmospheric pressure, which is required when the movable liquid 50, that exists in the low liquid-repellent area 41 adjacent to the high liquid-repellent film 40 on the ink chamber 31 side, enters the high liquid-repellent film 40. In other words, the difference between the atmospheric pressure and the internal pressure (hereinafter referred to as "lower limit pressure") of the ink chamber 31 required for the movable liquid 50 arranged on the low liquid-repellent area 41 to start entering the high liquid-repellent film 40 adjoining on the ink chamber 32 side is larger than the difference between the atmospheric pressure and the internal pressure (hereinafter referred to as "upper limit pressure") of the ink chamber 31 required for the movable liquid 50 arranged on the low liquid-repellent area 41 to start entering the high liquid-repellent film 40 adjoining on the atmospheric air side (see FIG. 3B). Therefore, the movable liquid 50 is moved in the pressure-adjusting space 32 so that the internal pressure of the ink chamber 31 is lower than the atmospheric pressure.

Next, the operation of the ink tank 11 will be explained with reference to FIGS. 3 to 7. FIGS. 3 to 7 show the operation of the ink tank 11. Each of FIGS. 3A to 7A shows a sectional view illustrating the state of the ink tank 11, and each of FIGS. 3B to 7B shows the change of the internal pressure of the ink chamber 31. The vertical axis indicates the internal pressure of the ink chamber 31, and the horizontal axis indicates the time. Upper broken lines indicate the upper limit pressure, and lower broken lines indicate the lower limit pressure.

Figure 4A:
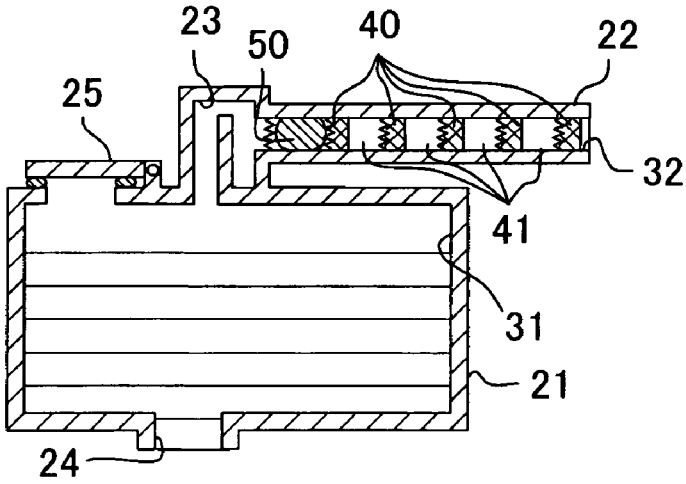
FIG. 4 shows a relationship between the operation state of the ink tank shown in FIG. 2 and the change in internal pressure in the ink chamber.
Figure 4B:
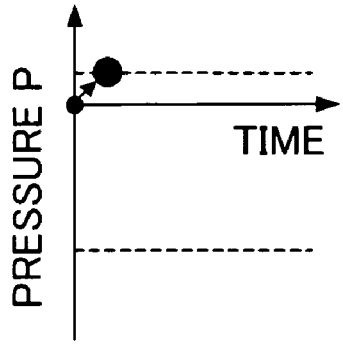
Figure 5A:
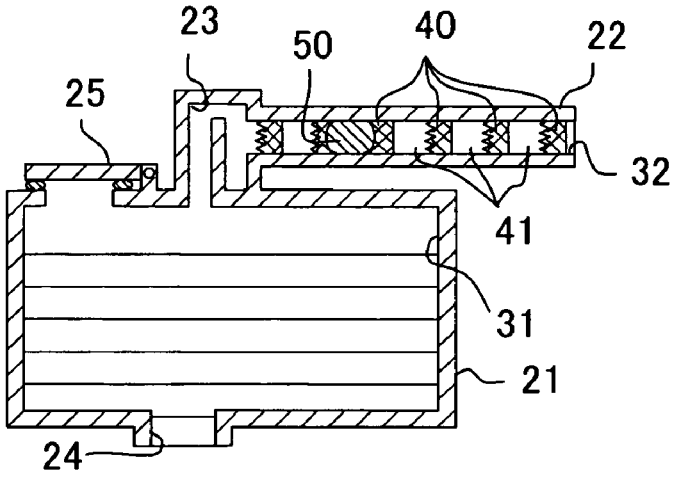
FIG. 5 shows a relationship between the operation state of the ink tank shown in FIG. 2 and the change in internal pressure in the ink chamber.
Figure 5B:
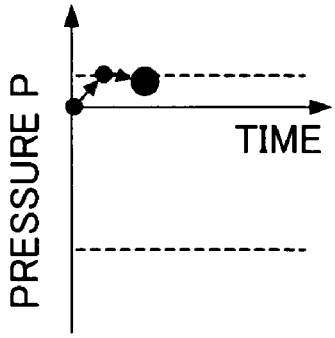

As shown in FIG. 3, when the ink tank 11, into which the ink has been injected, is installed to the carriage 12, the internal pressure of the ink chamber 31 is the same as the atmospheric pressure. For example, when the ink-jet printer 1 begins the operation, the temperature in the surrounding atmosphere is raised, because the respective components start the operation. As shown in FIG. 4, as the temperature is raise, the ink and the air accommodated in the ink chamber 31 are thermally expanded, and the internal pressure of the ink chamber 31 is increased. As described above, the difference in pressure between the upper limit pressure and the atmospheric pressure is small. Therefore, the internal pressure in the ink chamber 31 easily arrives at the upper limit pressure. When the internal pressure in the ink chamber 31 arrives at the upper limit pressure, the movable liquid 50, which is arranged on the low liquid-repellent area 41, begins to enter the high liquid-repellent film 40 which is disposed adjacently on the atmospheric air side. As shown in FIG. 5, the movable liquid 50, which has entered the high liquid-repellent film 40, is repelled by the high liquid-repellent film 40, and the movable liquid 50 is arranged on the next low liquid-repellent area 41 which is disposed adjacently to the high liquid-repellent film 40 on the farther atmospheric air side. Accordingly, the internal pressure of the ink chamber 31 is slightly lowered.

Figure 6A:
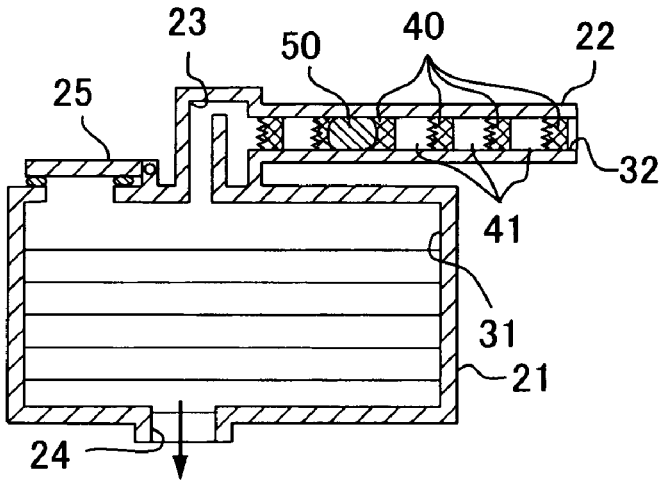
FIG. 6 shows a relationship between the operation state of the ink tank shown in FIG. 2 and the change in internal pressure in the ink chamber.
Figure 6B:
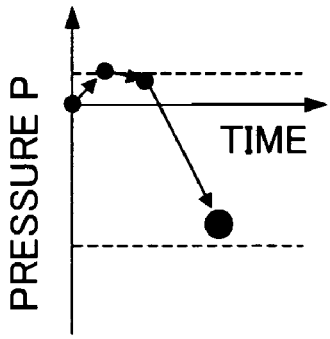
Figure 7A:
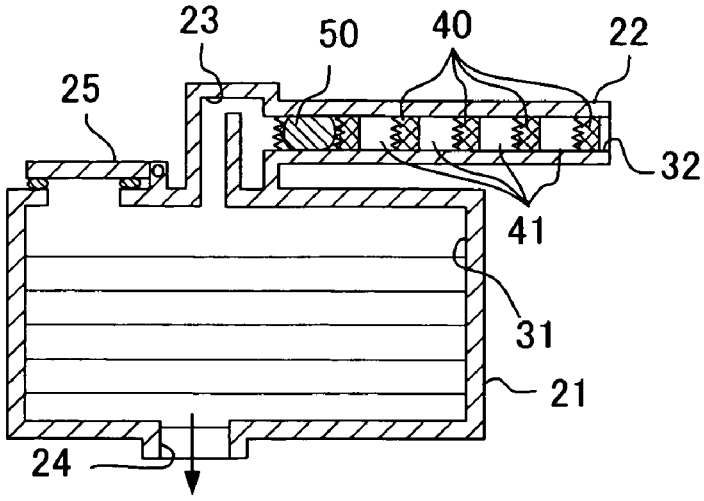
FIG. 7 shows a relationship between the operation state of the ink tank shown in FIG. 2 and the change in internal pressure in the ink chamber.
Figure 7B:
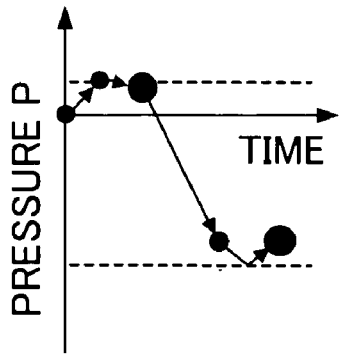

When the ink-jet printer 1 starts the printing operation, the ink contained in the ink chamber 31 is gradually consumed, as the ink droplets are discharged by the head main body 10. As shown in FIG. 6, when the ink contained in the ink chamber 31 is consumed, the internal pressure of the ink chamber 31 is lowered. When the internal pressure of the ink chamber 31 is lowered, then the movable liquid 50 is attracted toward the ink chamber 31 side, and it intends to enter the high liquid-repellent film 40 which is disposed adjacently on the ink chamber 31 side. However, when the internal pressure of the ink chamber 31 does not arrive at the lower limit pressure, the force of resistance, which is brought about by the liquid-repelling action of the high liquid-repellent film 40, is stronger than the force of the movable liquid 50 to enter the high liquid-repellent film 40. Therefore, the movable liquid 50 does not enter the high liquid-repellent film 40, and it stays on the low liquid-repellent area 41. As shown in FIG. 7, when the internal pressure of the ink chamber 31 arrives at the lower limit pressure, the force of the movable liquid 50 to enter the high liquid-repellent film 40 is larger than the force of resistance which is brought about the liquid-repelling action of the high liquid-repellent film 40. The movable liquid 50, which is arranged on the low liquid-repellent area 41, begins to enter the high liquid-repellent film 40 which is disposed adjacently on the ink chamber 31 side. The movable liquid 50, which has entered the high liquid-repellent film 40, is repelled by the high liquid-repellent film 40, and the movable liquid 50 is moved onto the next low liquid-repellent area 41 which is disposed adjacently to the high liquid-repellent film 40 on the farther ink chamber 31 side. Accordingly, the internal pressure of the ink chamber 31 is slightly raised. In this situation, the increase in the internal pressure of the ink chamber 31, which is generated such that the movable liquid 50 arranged on the low liquid-repellent area 41 is moved to the next low liquid-repellent area 41 arranged on the ink chamber 31 side, is sufficiently smaller than the difference in air pressure between the lower limit pressure and the atmospheric pressure. Therefore, the internal pressure of the ink chamber 31 is a negative pressure in the vicinity of the lower limit pressure.

During the printing, the inertial force acts on the movable liquid 50 toward the ink chamber 31 side and toward the atmospheric air side, as the ink-jet head 9 makes the reciprocating movement in the head transport direction Y. The movable liquid 50, which is positioned on the low liquid-repellent area 41, can easily enter the high liquid-repellent film 40 which is disposed adjacently on the atmospheric air side. Therefore, the movable liquid 50 enters the high liquid-repellent film 40 which is disposed adjacently on the atmospheric air side, and the movable liquid 50 is moved to the next low liquid-repellent area 41 which is disposed on the farther atmospheric air side in accordance with the inertial force which acts on the movable liquid 50 and which is directed toward the atmospheric air side. Accordingly, the internal pressure of the ink chamber 31 is slightly lowered. In this situation, when the internal pressure of the ink chamber 31 becomes lower than the lower limit pressure, the movable liquid 50 is moved onto the low liquid-repellent area 41 on which the movable liquid 50 was originally arranged. The movable liquid 50, which is arranged on the low liquid-repellent area 41, cannot easily enter the high liquid-repellent film 40 which is disposed adjacently on the ink chamber 31 side. Therefore, the movable liquid 50 does not enter the high liquid-repellent film 40 which is disposed adjacently on the ink chamber 31 side, by the inertial force which acts on the movable liquid 50 and which is directed toward the ink chamber 31 side. As described above, the internal pressure of the ink chamber 31 is stabilized at a negative pressure in the vicinity of the lower limit pressure. The ink chamber 31 is suppressed from any great increase in the internal pressure.

According to the first embodiment explained above, it is possible to suppress any great increase in the internal pressure of the ink chamber 31 irrelevant to the position of arrangement of the ink tank 11. Accordingly, there is no restriction by the relative positional relationship between the head main body 10 and the ink tank 11. The head main body 10 and the ink tank 11 can be efficiently arranged in order to miniaturize the ink-jet printer 1. Further, the ink-jet printer 1 can be made mobile. Furthermore, the internal pressure of the ink chamber 31 is hardly changed as the time elapses, because the movable liquid 50 and the high liquid-repellent film 40 are hardly deteriorated. Accordingly, the ink tank 11 can be used for a longer period of time, and it is possible to lower the running cost.

The ink supply system, which includes the ink chamber 31 of the ink tank 11, has the internal pressure which can be maintained at an appropriate negative pressure. Therefore, it is possible to efficiently discharge the ink droplets from the nozzles while avoiding the ink leakage from the nozzles.

The cross-sectional shape of the pressure-adjusting tube 22, which is perpendicular to the extending direction, is annular. Therefore, the high liquid-repellent film 40 and the low liquid-repellent area 41 are annular along the inner wall of the pressure-adjusting space 32. Accordingly, the movable liquid 50 is repelled by the high liquid-repellent film 40, and is easily positioned on the low liquid-repellent area 41. Thus, it is possible to efficiently suppress the change in the internal pressure of the ink chamber 31.

Further, the pressure-adjusting space 32 is open to the atmospheric air. Therefore, the atmospheric air can be used as the reference pressure for the internal pressure of the ink chamber 31.

Additionally, the boundary line of the high liquid-repellent film 40, which is disposed on the atmospheric air side, is composed of the straight line which is perpendicular to the extending direction of the pressure-adjusting tube 22 (direction of movement of the movable liquid 50). Further, the boundary line, which is disposed on the ink chamber 31 side, is composed of the zigzag shape wherein the straight lines, which have the opposite directions of inclination with respect to the straight line perpendicular to the extending direction of the pressure-adjusting tube 22, are alternately aligned. Therefore, the difference in air pressure between the both sides of the movable liquid 50, which is brought about when the movable liquid 50 existing on the low liquid-repellent area 41 enters the high liquid-repellent film 40 disposed adjacently on the ink chamber 31 side, is larger than the difference in air pressure between the both sides of the movable liquid 50 which is brought about when the movable liquid 50 enters the high liquid-repellent film 40 disposed adjacently on the atmospheric air side. As described above, it is possible to suppress any great increase in the internal pressure of the ink chamber 31 by using the simple arrangement in which the shape of the high liquid-repellent film 40 differs between the ink chamber side and the atmospheric air side.

Figure 8:
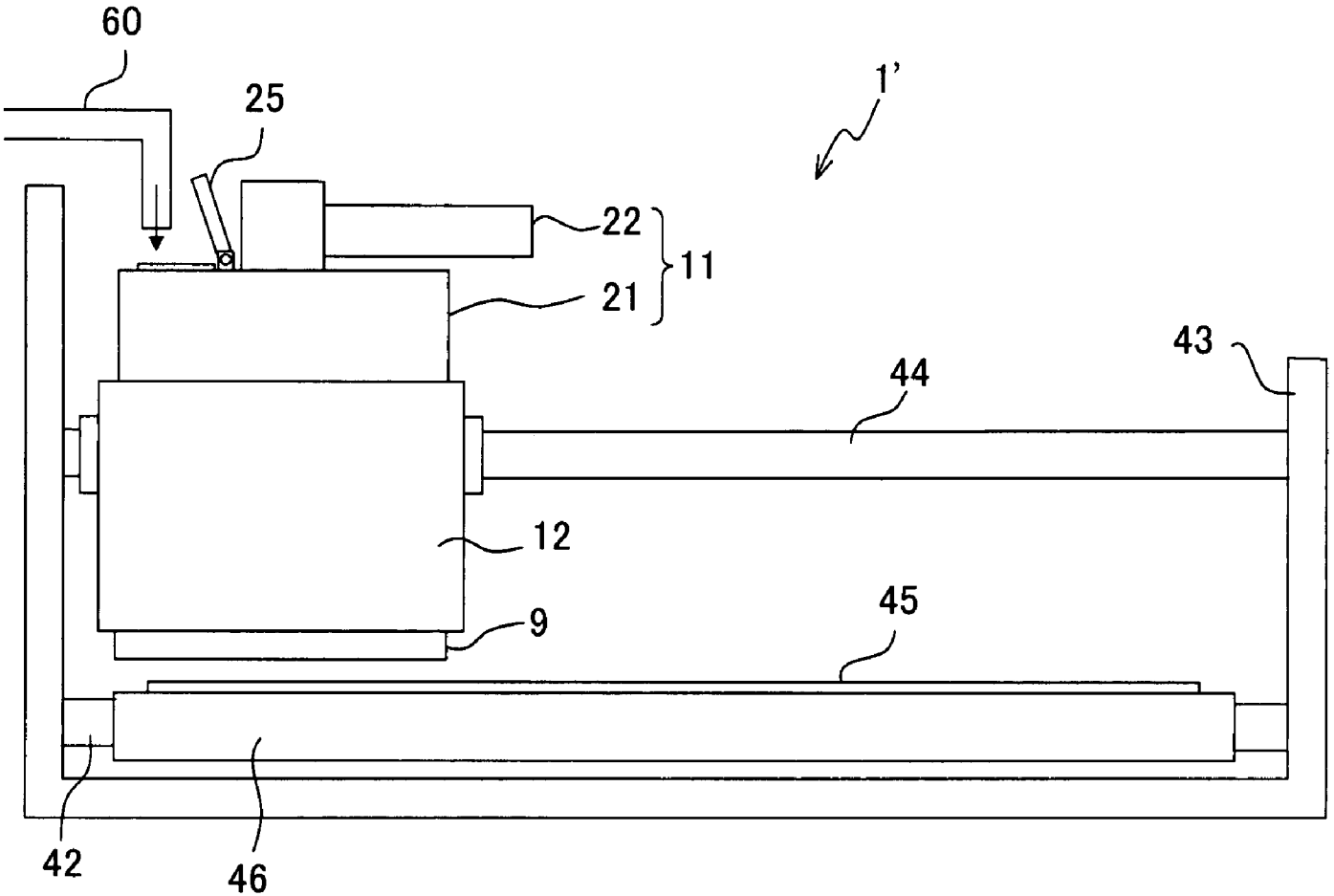
FIG. 8 shows a modified embodiment of the first embodiment.

Next, an explanation will be made with reference to FIG. 8 about a modified embodiment of the first embodiment. FIG. 8 shows an appearance of an ink-jet printer 1'. The first embodiment has been constructed such that the ink tank 11 is detachable with respect to the carriage 12, and the ink is poured or injected by detaching the ink tank 11 from the carriage 12. However, there is no limitation to the construction of this type. For example, the ink tank 11 may be fixed to the carriage 12. In this arrangement, as shown in FIG. 8, an ink outflow tube 60 is further provided for allowing the ink to outflow into the ink-jet printer 1'. When the ink is poured into the ink tank 11, then the hatch 25 is opened, and the ink-jet head 9 is moved so that the hole 31*a* of the tank main body 21 is opposed to the opening of the ink outflow tube 60. The ink may be allowed to flow into the hole 31*a* from the ink outflow tube 60 after the hole 31*a* is opposed to the opening of the ink outflow tube 60.

Figure 9:
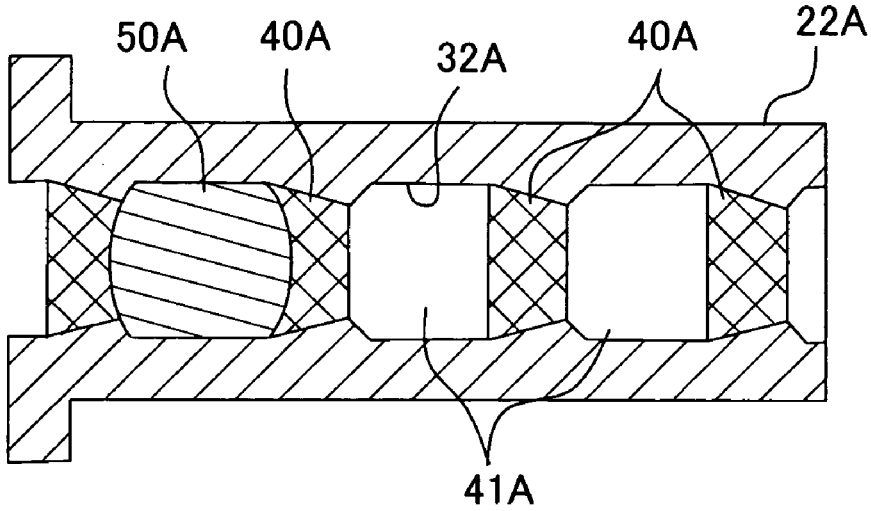
FIG. 9 shows a sectional view illustrating a pressure-adjusting tube provided for an ink tank according to a second embodiment of the present invention.

Next, a second embodiment according to the present invention will be explained with reference to FIG. 9. In the second embodiment, only the pressure-adjusting tube is constructed differently from the first embodiment. Therefore, only the pressure-adjusting tube will be explained below. Substantially the same members as those of the first embodiment are designated by the same reference numerals as those used in the first embodiment, any explanation of which will be omitted. FIG. 9 shows a sectional view illustrating a pressure-adjusting tube 22A according to the second embodiment.

The pressure-adjusting tube 22A has such a cylindrical shape that the pressure-adjusting tube 22A extends from the communication passage 23 in the head transport direction. A pressure-adjusting space 32A is formed in the pressure-adjusting tube 22A. The cross-sectional shape of the pressure-adjusting space 32A, which is perpendicular to the extending direction of the pressure-adjusting space 32A, is annular. One end of the pressure-adjusting space 32A is communicated with the atmospheric air (open to the atmospheric air), and the other end is communicated with the communication passage 23. In the following description, the side of one end of the pressure-adjusting space 32A, which is communicated with the atmospheric air, is referred to as "atmospheric air side (side far from the main space)", and the side of the other end, which is communicated with the ink chamber 31 via the communication passage 23, is referred to as "ink chamber 31 side (side near to the main space)". A large number of high liquid-repellent films (second areas) 40A, which have liquid repellence higher than liquid repellence of the inner wall of the pressure-adjusting space 32A, are formed on the inner wall of the pressure-adjusting space 32A so that the high liquid-repellent films 40A are annular along the inner wall of the pressure-adjusting space 32A. The high liquid-repellent films 40A are arranged in the pressure-adjusting space 32A so that the high liquid-repellent films 40A and low liquid-repellent areas (first areas) 41A on which the high liquid-repellent films 40A are not formed appear alternately in the extending direction of the pressure-adjusting space 32A. In this arrangement, the low liquid-repellent areas 41A are annular along the inner wall of the pressure-adjusting space 32A. The boundary lines of the high liquid-repellent film 40A, which are disposed with respect to the low liquid-repellent areas 41A on the both sides, are composed of straight lines which are perpendicular to the extending direction of the pressure-adjusting tube 22A. A diameter of a cross section of the high liquid-repellent film 40A, which extends along the boundary line with respect to the low liquid-repellent area 41A on the ink chamber 31 side, is larger than a diameter of a cross section which extends along the boundary line with respect to the low liquid-repellent area 41 on the atmospheric air side.

A movable liquid 50A, which is movable on the high liquid-repellent films 40A and the low liquid-repellent areas 41A in the extending direction of the pressure-adjusting space 32A, is arranged in the pressure-adjusting space 32A so that the pressure-adjusting space 32A is shut off (isolated to two spaces by the movable liquid 50A so that one of the spaces is not communicated with the atmospheric air). The movable liquid 50A is repelled by the high liquid-repellent film 40A. Therefore, the movable liquid 50A always stops on any one of the low liquid-repellent areas 41A. When the movable liquid 50A is positioned on the low liquid-repellent area 41A, the movable liquid 50A makes contacts with ends of the high liquid-repellent films 40A which are disposed adjacently to the low liquid-repellent area 41A on the both sides. The movable liquid 50A forms the meniscus so that a predetermined angle of elevation is provided at the contact surface with respect to the high liquid-repellent film 40A.

When the diameter of the cross section of the high liquid-repellent film 40A extending along the boundary line on the ink chamber 31 side is larger than the diameter of the cross section along the boundary line on the atmospheric air side, the movable liquid 50A, which is arranged on the low liquid-repellent area 41A, easily enters the high liquid-repellent film 40A which is disposed adjacently on the atmospheric air side as compared with the high liquid-repellent film 40A which is disposed adjacently on the ink chamber 31 side. That is, the size of the diameter of the cross-sectional portion is proportional to the critical pressure brought about when the meniscus of the movable liquid 50A existing at the cross-sectional portion is broken and the movable liquid 50A is moved from the cross-sectional portion. Accordingly, the direction of movement of the movable liquid 50A is adjusted by adjusting the size of the cross section. Therefore, the liquid repellence of the high liquid-repellent film 40A may be the same as that of the low liquid-repellent area 41A, although the liquid repellence of the high liquid-repellent film 40A is different from that of the low liquid-repellent area 41A in this embodiment. That is, the high liquid-repellent films 40A may be omitted on condition that the sizes of the diameters of the cross-sectional portions are different from each other.

According to the second embodiment explained above, it is possible to reliably increase the force of resistance exerted when the movable liquid 50A, which is arranged on the low liquid-repellent area 41A, enters the high liquid-repellent film 40A which is disposed adjacently on the ink chamber 31 side. Accordingly, the difference in air pressure between the both sides of the movable liquid 50A, which is brought about when the movable liquid 50A existing on the low liquid-repellent area 41A enters the high liquid-repellent film 40A disposed adjacently on the ink chamber 31 side, can be made much greater than the difference in air pressure between the both sides of the movable liquid 50A, which is brought about when the movable liquid 50A enters the high liquid-repellent film 40A disposed adjacently on the atmospheric air side. Therefore, it is possible to suppress any great increase in the internal pressure while maintaining the internal pressure of the ink chamber 31 at a lower pressure.

Figure 10:
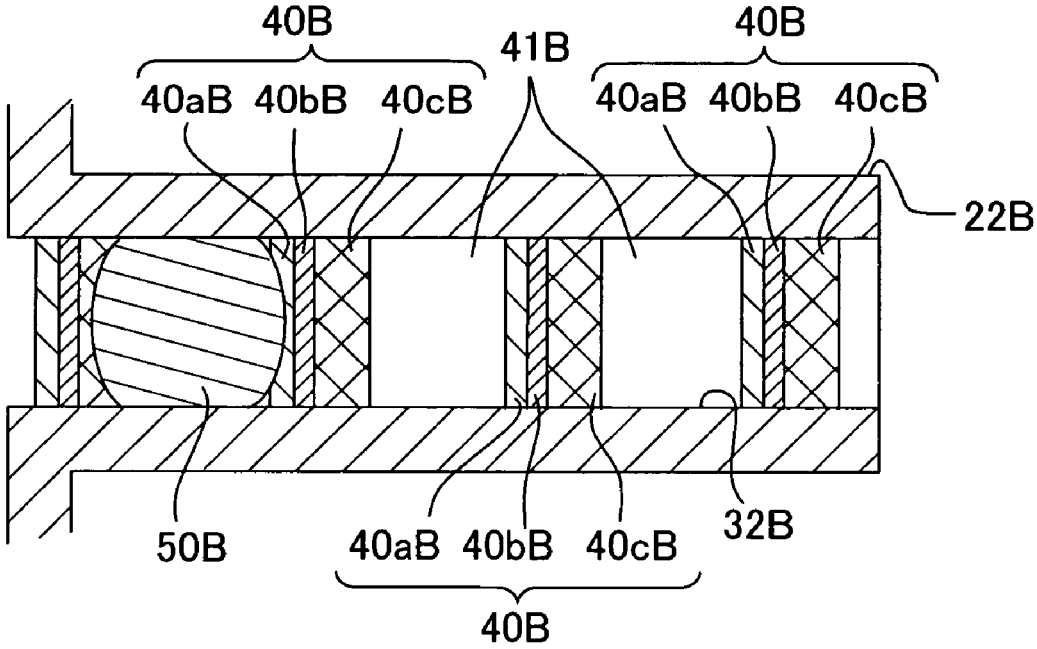
FIG. 10 shows a sectional view illustrating a pressure-adjusting tube provided for an ink tank according to a third embodiment of the present invention.

Next, a third embodiment according to the present invention will be explained with reference to FIG. 10. In the third embodiment, only the pressure-adjusting tube is constructed differently from the first embodiment. Therefore, only the pressure-adjusting tube will be explained below. Substantially the same members as those of the first embodiment are designated by the same reference numerals as those used in the first embodiment, any explanation of which will be omitted. FIG. 10 shows a sectional view illustrating a pressure-adjusting tube 22B according to the third embodiment.

The pressure-adjusting tube 22B has such a cylindrical shape that the pressure-adjusting tube 22B extends from the communication passage 23 in the head transport direction. A pressure-adjusting space 32B is formed in the pressure-adjusting tube 22B. The cross-sectional shape of the pressure-adjusting space 32B, which is perpendicular to the extending direction of the pressure-adjusting space 32B, is annular. One end of the pressure-adjusting space 32B is communicated with the atmospheric air (open to the atmospheric air), and the other end is communicated with the communication passage 23. In the following description, the side of one end of the pressure-adjusting space 32B, which is communicated with the atmospheric air, is referred to as "atmospheric air side (side far from the main space)", and the side of the other end, which is communicated with the ink chamber 31 via the communication passage 23, is referred to as "ink chamber 31 side (side near to the main space)". A large number of high liquid-repellent films (second areas) 40B, which have liquid repellence higher than liquid repellence of the inner wall of the pressure-adjusting space 32B, are formed on the inner wall of the pressure-adjusting space 32B so that the high liquid-repellent films 40B are annular along the inner wall of the pressure-adjusting space 32B.

The high liquid-repellent film 40B includes a first high liquid-repellent film 40*a*B, a second high liquid-repellent film 40*b*B, and a third high liquid-repellent film 40*c*B which are arranged in the extending direction of the pressure-adjusting space 32B and which are disposed adjacently and successively from the ink chamber 31 side. The second high liquid-repellent film 40*b*B has liquid repellence higher than that of the first high liquid-repellent film 40*a*B. The third high liquid-repellent film 40*c*B has liquid repellence higher than that of the second high liquid-repellent film 40*b*B. In other words, the liquid repellence is increased in a stepwise manner on the high liquid-repellent film 40B in an order of the first high liquid-repellent film 40*a*B, the second high liquid-repellent film 40*b*B, and the third high liquid-repellent film 40*c*B from the ink chamber 31 side toward the atmospheric air side. The high liquid-repellent films 40B are arranged in the pressure-adjusting space 32B such that the high liquid-repellent films 40B and low liquid-repellent areas (first areas) 41B in which the high liquid-repellent films 40B are not formed appear alternately in the extending direction of the pressure-adjusting space 32B. The low liquid-repellent area 41B is annular along the inner wall of the pressure-adjusting space 32B. The boundary lines of the high liquid-repellent film 40B with respect to the low liquid-repellent areas 41B on the both sides are composed of straight lines which are perpendicular to the extending direction of the pressure-adjusting tube 22B.

A movable liquid 50B, which is movable on the high liquid-repellent films 40B and the low liquid-repellent areas 41B in the extending direction of the pressure-adjusting space 32B, is arranged in the pressure-adjusting space 32B so that the pressure-adjusting space 32B is shut off (isolated to two spaces by the movable liquid 50B so that one of the spaces is not communicated with the atmospheric air). The movable liquid 50B is repelled by the high liquid-repellent film 40B. Therefore, the movable liquid 50B always stops on any one of the low liquid-repellent areas 41B. When the movable liquid 50B is positioned on the low liquid-repellent area 41B, the movable liquid 50B makes contacts with ends of the high liquid-repellent films 40B which are disposed adjacently to the low liquid-repellent area 41B on the both sides. The movable liquid 50B forms the meniscus so that a predetermined angle of elevation is provided at the contact surface with respect to the high liquid-repellent film 40B.

As described above, the liquid repellence is increased in the stepwise manner on the high liquid-repellent film 40B in the order of the first high liquid-repellent film 40*a*B, the second high liquid-repellent film 40*b*B, and the third high liquid-repellent film 40*c*B from the ink chamber 31 side toward the atmospheric air side. Therefore, the movable liquid 50B, which is arranged on the low liquid-repellent area 41B, easily enters the high liquid-repellent film 40B which is disposed adjacently on the atmospheric air side as compared with the high liquid-repellent film 40B which is disposed adjacently on the ink chamber 31 side.

According to the third embodiment explained above, it is possible to increase the force of resistance exerted when the movable liquid 50B, which is arranged on the low liquid-repellent area 41B, enters the high liquid-repellent film 40B which is disposed adjacently on the ink chamber 31 side, and it is possible to decrease the force of resistance exerted when the movable liquid 50B enters the high liquid-repellent film 40B which is disposed adjacently on the atmospheric air side. Accordingly, it is possible to more accurately suppress the increase in the internal pressure of the ink chamber 31.

Figure 11:
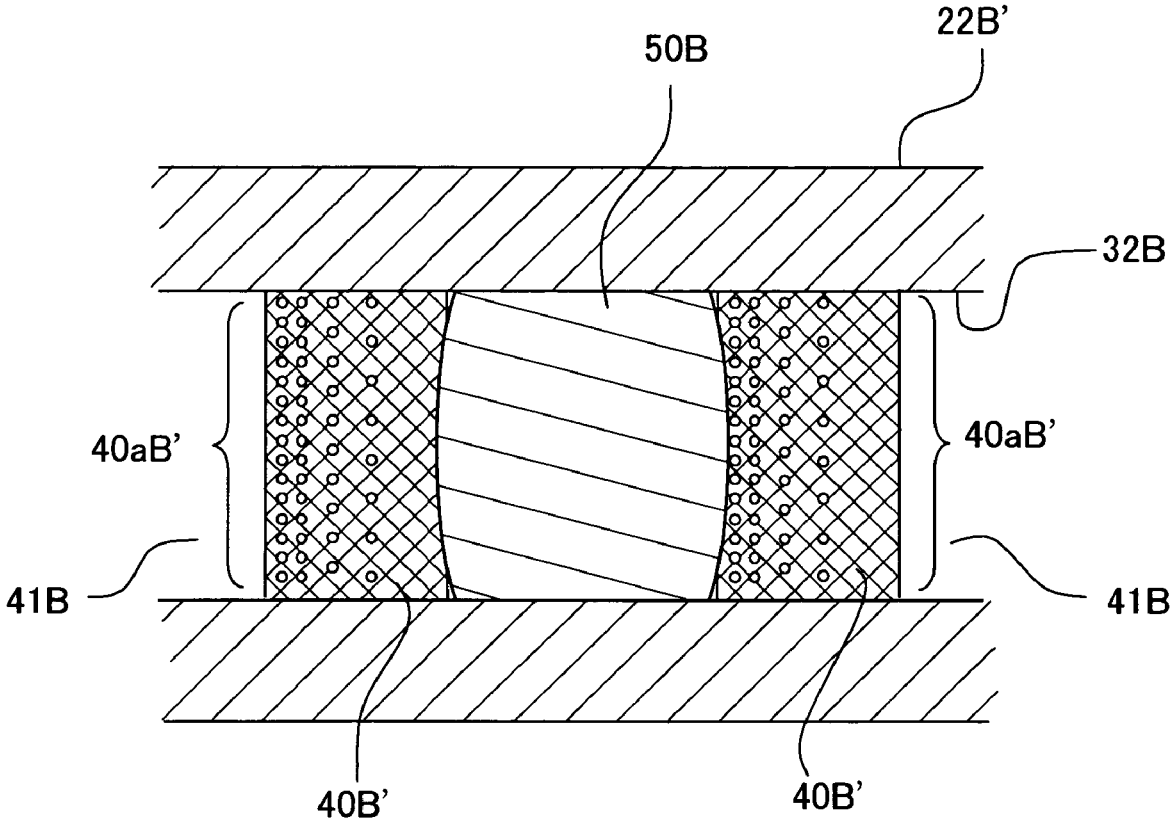
FIG. 11 shows a modified embodiment of the third embodiment.

Next, a modified embodiment of the third embodiment will be explained with reference to FIG. 11. FIG. 11 shows a magnified sectional view illustrating a modified embodiment of the pressure-adjusting tube. The third embodiment has been constructed to provide the high liquid-repellent film 40B in which the liquid repellence is increased in the stepwise manner in the order of the first high liquid-repellent film 40*a*B, the second high liquid-repellent film 40*b*B, and the third high liquid-repellent film 40*c*B from the ink chamber 31 side toward the atmospheric air side. However, there is no limitation to the construction as described above provided that the liquid repellence is gradually increased from the ink chamber 31 side toward the atmospheric air side. For example, as shown in FIG. 11, high liquid-repellent films (second areas) 40B', which have liquid repellence higher than liquid repellence of the inner wall of the pressure-adjusting space 32B, may be formed to be annular along the inner wall of the pressure-adjusting space 23B. A large number of holes 40*a*B, from which the inner wall of the pressure-adjusting space 32B is exposed, may be formed through the high liquid-repellent film 40B' so that the density is gradually increased from the atmospheric air side toward the ink chamber 31 side (average density of the portions having the different liquid repellence is increased). In place of the high liquid-repellent films 40B', dot-shaped high liquid-repellent films, which are arranged annularly along the inner wall of the pressure-adjusting space 32B, may be formed so that the density is gradually increased from the ink chamber 31 side toward the atmospheric air side.

According to this arrangement, it is possible to gradually increase the force of resistance exerted when the movable liquid 50B, which is arranged on the low liquid-repellent area 41B, enters the high liquid-repellent film 40B', which is disposed adjacently on the ink chamber 31 side, and it is possible to gradually decrease the force of resistance exerted when the movable liquid 50B enters the high liquid-repellent film 40B' which is disposed adjacently on the atmospheric air side. Accordingly, it is possible to more accurately suppress the increase in the internal pressure of the ink chamber 31.

Figure 12:
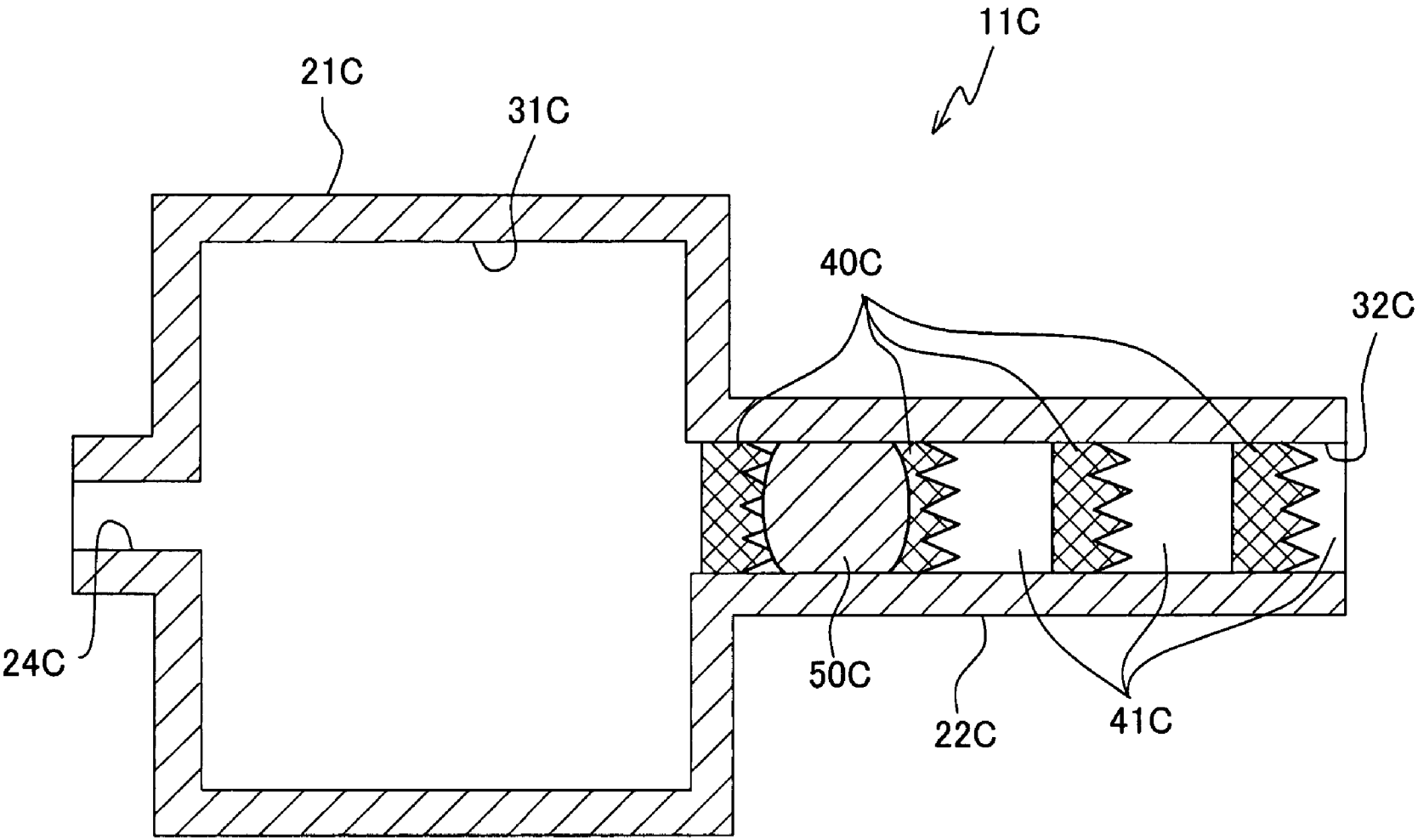
FIG. 12 shows a sectional view illustrating a pressure-stabilizing apparatus according to a fourth embodiment of the present invention.

Next, a fourth embodiment according to the present invention will be explained with reference to FIG. 12. FIG. 12 shows a sectional view illustrating a pressure-stabilizing apparatus 11C according to the fourth embodiment. The pressure-stabilizing apparatus 11C functions such that the internal pressure of a space in which the pressure tends to increase is stabilized to have a predetermined pressure. As shown in FIG. 12, the pressure-stabilizing apparatus 11C includes a main casing (main wall member) 21C and a pressure-adjusting tube (subsidiary wall member) 22C. The main casing 21C includes a chamber 31C which serves as an internal space, and a communication passage 24C which is communicated with a space in which the internal pressure is to be stabilized.

The pressure-adjusting tube 22C has a cylindrical shape which extends from the main casing 21C in one direction. A pressure-adjusting space 32C is formed in the pressure-adjusting tube 22C. A cross-sectional shape, which is perpendicular to the extending direction of the pressure-adjusting tube 22C, is annular. One end of the pressure-adjusting space 32C is communicated with the atmospheric air (open to the atmospheric air), and the other end is communicated with the chamber 31C. In the following description, the side of one end of the pressure-adjusting space 32C, which is communicated with the atmospheric air, is referred to as "atmospheric air side (side far from the main space)", and the side of the other end, which is communicated with the chamber 31C, is referred to as "chamber 31C side (side near to the main space)". A large number of high liquid-repellent films (second areas) 40C, which have liquid repellence higher than liquid repellence of the inner wall of the pressure-adjusting space 32C, are formed on the inner wall of the pressure-adjusting space 32C so that the high liquid-repellent films 40C are annular along the inner wall of the pressure-adjusting space 32C. The high liquid-repellent films 40C are arranged in the pressure-adjusting space 32C so that the high liquid-repellent films 40C and low liquid-repellent areas (first areas) 41C on which the high liquid-repellent films 40C are not formed appear alternately in the extending direction of the pressure-adjusting space 32C. In this arrangement, the low liquid-repellent areas 41C are annular along the inner wall of the pressure-adjusting space 32C. The boundary line of the high liquid-repellent film 40C, which is disposed with respect to the low liquid-repellent area 41C on the chamber 31C side, is composed of a straight line which is perpendicular to the extending direction of the pressure-adjusting tube 22C. The boundary line, which is disposed with respect to the low liquid-repellent area 41C on the atmospheric air side, has a zigzag shape in which straight lines having opposite directions of inclination with respect to the straight line perpendicular to the extending direction of the pressure-adjusting tube 22C are alternately aligned.

A movable liquid 50C, which is movable on the high liquid-repellent films 40C and the low liquid-repellent areas 41C in the extending direction of the pressure-adjusting space 32C, is arranged in the pressure-adjusting space 32C so that the pressure-adjusting space 32C is shut off (isolated to two spaces by the movable liquid 50C so that one of the spaces is not communicated with the atmospheric air). The movable liquid 50C is repelled by the high liquid-repellent film 40C. Therefore, the movable liquid 50C always stops on any one of the low liquid-repellent areas 41C. When the movable liquid 50C is positioned on the low liquid-repellent area 41C, the movable liquid 50C makes contacts with ends of the high liquid-repellent films 40C which are disposed adjacently to the low liquid-repellent area 41C on the both sides. The movable liquid 50C forms the meniscus so that a predetermined angle of elevation is provided at the contact surface with respect to the high liquid-repellent film 40C.

In other words, the difference between the atmospheric pressure and the internal pressure (hereinafter referred to as "upper limit pressure") of the chamber 31C required for the movable liquid 50C arranged on the low liquid-repellent area 41C to start entering the high liquid-repellent film 40C adjoining on the atmospheric air side is larger than the difference between the atmospheric pressure and the internal pressure (hereinafter referred to as "lower limit pressure") of the chamber 31C required for the movable liquid 50C arranged on the low liquid-repellent area 41C to start entering the high liquid-repellent film 40C adjoining on the chamber 31C side. Therefore, the movable liquid 50C is moved in the pressure-adjusting space 32C so that the internal pressure of the chamber 31C is higher than the atmospheric pressure. A detailed explanation about the operation of the pressure-stabilizing apparatus 11C is substantially the same as that described in the first embodiment, which is omitted.

According to the fourth embodiment explained above, it is possible to suppress any great decrease in the internal pressure of the chamber 31C and the space communicated therewith irrelevant to the position of arrangement of the internal pressure-stabilizing apparatus 21C. Further, the internal pressure of the chamber 31C is hardly changed as the time elapses, because the movable liquid 50C and the high liquid-repellent film 40C are hardly deteriorated. Therefore, the present invention, especially in this embodiment, is usable for the way of use in which it is required to maintain a constant pressure in a chamber, for example, for a clean room and a room in which musical instrument or precision mechanical equipment is installed.

Several embodiments of the present invention have been explained above. However, the present invention is not limited to the embodiments described above, which may be differently designed and changed in various forms within the scope defined in claims. For example, in the first embodiment, the cross section of the pressure-adjusting space 32, which is perpendicular to the extending direction, is annular, and the high liquid-repellent film 40 and the low liquid-repellent area 41 are also annular along the inner wall of the pressure-adjusting space 32. However, the pressure-adjusting space 32, the high liquid-repellent film 40, and the low liquid-repellent area 41 may have shapes other than the annular shapes. For example, the pressure-adjusting space may be a space defined by a wall surface having a U-shaped cross section, and the high liquid-repellent film 40 and the low liquid-repellent area may be U-shaped along the inner wall of the pressure-adjusting space. In this arrangement, the U-shaped opening may be arranged to serve as an upper surface, and the U-shaped opening may be sealed with a plate member. It is preferable that the inner portion of the plate member has liquid repellence which is intermediate between those of the high liquid-repellent film and the low liquid-repellent area.

The first embodiment is constructed such that the shut off space, which is the space disposed on the side opposite to the ink chamber 31 side shut off by the movable liquid 50, is communicated with the atmospheric air. However, there is no limitation to the construction as described above. The shut off space may be tightly sealed, or it may be communicated with another space. In any case, the change or fluctuation in the internal pressure of the ink chamber 31 is suppressed on the basis of the pressure of the shut off space.

Additionally, in the first embodiment, the present invention is applied to the ink tank 11 having the ink chamber 31. However, the present invention is applicable to all spaces in which the change in the internal pressure is to be suppressed.

The first embodiment is constructed such that the pressure-adjusting tube 22 has the cylindrical shape with the circular cross section, and the high liquid-repellent films 40 are formed annularly along the inner wall thereof. However, there is no limitation to the construction as described above. The pressure-adjusting tube may have a rectangular cross section, and the high liquid-repellent films may be formed only on the upper surface and the bottom surface of the inner wall thereof.

In the first embodiment, the ink tank 11 is detachable with respect to the carriage 12. However, there is no limitation to the construction as described above. The ink-jet printer 1 may be equipped with the ink tank 11. Alternatively, the ink tank may be an ink tank of the exchangeable cartridge type. Also in this case, the ink tank may be installed to the carriage 12, or the ink tank may be installed to the printer main body or the case. When the ink tank and the head are set up separately from each other, they can be connected to one another via a flexible tube through which the ink flows.

What is claimed is:

1. An internal pressure-stabilizing apparatus comprising:

a main wall member which defines a main space which accommodates a gas in at least a part thereof; and a subsidiary wall member which defines a subsidiary space communicated with the main space, wherein:

a plurality of first areas and a plurality of second areas having liquid repellence higher than that of the first areas are formed alternately in an extending direction of the subsidiary space on an inner wall of the subsidiary wall member; and a difference in air pressure between both sides of a liquid, which is required for the liquid to enter a second area of the second areas when the liquid exists on a first area of the first areas disposed adjacently to the second area on a side far from the main space, is different from a difference in air pressure between both sides of a liquid which is required for the liquid to enter the second area when the liquid exists on a first area disposed adjacently to the second area on a side near to the main space.

2. The internal pressure-stabilizing apparatus according to claim 1, wherein the subsidiary space has an annular cross-sectional shape which is perpendicular to the extending direction thereof, and the first areas and the second areas are formed annularly along the inner wall of the subsidiary wall member.

3. The internal pressure-stabilizing apparatus according to claim 2, wherein a size of a cross-sectional area of the second area, which is established at one end in the extending direction of the subsidiary space, is different from a size of a cross-sectional area of the second area which is established at the other end.

4. The internal pressure-stabilizing apparatus according to claim 1, wherein the difference in air pressure between the both sides of the liquid, which is required for the liquid to enter the second area when the liquid exists on the first area disposed adjacently to the second area on the side far from the main space, is larger than the difference in air pressure between the both sides of the liquid which is required for the liquid to enter the second area when the liquid exists on the first area disposed adjacently to the second area on the side near to the main space.

5. The internal pressure-stabilizing apparatus according to claim 4, wherein:

a boundary line between the first area and the second area disposed adjacently to the first area on the side far from the main space is a line which is perpendicular to the extending direction of the subsidiary space; and a boundary line between the first area and the second area disposed adjacently to the first area on the side near to the main space is a zigzag line.

6. The internal pressure-stabilizing apparatus according to claim 1, wherein the difference in air pressure between the both sides of the liquid, which is required for the liquid to enter the second area when the liquid exists on the first area disposed adjacently to the second area on the side far from the main space, is smaller than the difference in air pressure between the both sides of the liquid which is required for the liquid to enter the second area when the liquid exists on the first area disposed adjacently to the second area on the side near to the main space.

7. The internal pressure-stabilizing apparatus according to claim 6, wherein:

a boundary line between the first area and the second area disposed adjacently to the first area on the side near to the main space is a line which is perpendicular to the extending direction of the subsidiary space; and a boundary line between the first area and the second area disposed adjacently to the first area on the side far from the main space is a zigzag line.

8. The internal pressure-stabilizing apparatus according to claim 1, wherein the subsidiary space is open to atmospheric air.

9. The internal pressure-stabilizing apparatus according to claim 1, wherein a boundary line between the second area and one of two of the first areas disposed adjacently to the second area is a zigzag line.

10. The internal pressure-stabilizing apparatus according to claim 1, wherein a plurality of zones, which have liquid repellence higher than that of the first area, are provided in the second area so that the liquid repellence is gradually increased from one side to the other side of the second area in the extending direction of the subsidiary space.

11. The internal pressure-stabilizing apparatus according to claim 1, wherein:

a large number of portions, which have liquid repellence different from that of the second area, are formed in the second area; and an average density of the portions having the different liquid repellence in the second area is gradually increased from one side to the other side in the extending direction of the subsidiary space.

12. The internal pressure-stabilizing apparatus according to claim 1, wherein an ink is accommodated in the main space, and an ink supply tube is formed to supply the ink contained in the main space to outside.

13. The internal pressure-stabilizing apparatus according to claim 1, wherein liquid repellence of a boundary portion between the first area and the second area disposed adjacently to the first area on the side far from the main space is higher than liquid repellence of a boundary portion between the first area and the second area disposed adjacently to the first area on the side near to the main space.

14. The internal pressure-stabilizing apparatus according to claim 1, wherein liquid repellence of a boundary portion between the first area and the second area disposed adjacently to the first area on the side far from the main space is lower than liquid repellence of a boundary portion between the first area and the second area disposed adjacently to the first area on the side near to the main space.

15. An ink tank for an ink-jet printer comprising:

a main wall member which defines a main space which accommodates an ink and which has an ink discharge port to be communicated with nozzles which discharge the ink; and a subsidiary wall member which defines a subsidiary space communicated with the main space and which has an open hole which opens the subsidiary space to atmospheric air, wherein:

a plurality of first areas and a plurality of second areas having liquid repellence higher than that of the first areas are formed alternately in an extending direction of the subsidiary space on an inner wall of the subsidiary wall member; and a difference in air pressure between both sides of a liquid, which is required for the liquid to enter a second area of the second areas when the liquid exists on a first area of the first areas disposed adjacently to the second area on a side far from the main space, is larger than a difference in air pressure between both sides of a liquid which is required for the liquid to enter the second area when the liquid exists on a first area disposed adjacently to the second area on a side near to the main space.

16. The ink tank according to claim 15, wherein the subsidiary space extends in a horizontal direction.

17. The ink tank according to claim 15, wherein liquid repellence of a boundary portion between the first area and the second area disposed adjacently to the first area on the side far from the main space is higher than liquid repellence of a boundary portion between the first area and the second area disposed adjacently to the first area on the side near to the main space.

18. The ink tank according to claim 15, wherein liquid repellence of a boundary portion between the first area and the second area disposed adjacently to the first area on the side far from the main space is lower than liquid repellence of a boundary portion between the first area and the second area disposed adjacently to the first area on the side near to the main space.

19. The ink tank according to claim 15, wherein the subsidiary space has an annular cross-sectional shape which is perpendicular to the extending direction thereof, the first areas and the second areas are formed annularly along the inner wall of the subsidiary wall member, and a size of a cross-sectional area of the second area, which is established at one end in the extending direction of the subsidiary space, is different from a size of a cross-sectional area of the second area which is established at the other end.

20. An ink-jet printer comprising:

an ink-jet head which discharges an ink; and an ink tank which stores the ink to be supplied to the ink-jet head, the ink tank comprising:

a main wall member which defines a main space which accommodates the ink and which has an ink discharge port to be communicated with nozzles which discharge the ink; and a subsidiary wall member which defines a subsidiary space communicated with the main space and which has an open hole which opens the subsidiary space to atmospheric air, wherein:

a plurality of first areas and a plurality of second areas having liquid repellence higher than that of the first areas are formed alternately in an extending direction of the subsidiary space on an inner wall of the subsidiary wall member; and a difference in air pressure between both sides of a liquid, which is required for the liquid to enter a second area of the second areas when the liquid exists on a first area of the first areas disposed adjacently to the second area on a side far from the main space, is larger than a difference in air pressure between both sides of a liquid which is required for the liquid to enter the second area when the liquid exists on a first area disposed adjacently to the second area on a side near to the main space.

* * * * *